US007032578B2

(12) United States Patent
Liu et al.

(10) Patent No.: US 7,032,578 B2
(45) Date of Patent: Apr. 25, 2006

(54) VENTURI MIXING SYSTEM FOR EXHAUST GAS RECIRCULATION (EGR)

(75) Inventors: Zhengbai Liu, Naperville, IL (US); Laura M. Ricart-Ugaz, Chicago, IL (US); Timothy Chang, Canton, MI (US); Yuanxian Zhu, Naperville, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/945,618

(22) Filed: Sep. 21, 2004

(65) Prior Publication Data

US 2006/0060172 A1 Mar. 23, 2006

(51) Int. Cl.
*F02B 47/08* (2006.01)

(52) U.S. Cl. ..... 123/568.15; 123/568.17; 123/568.18

(58) Field of Classification Search ..... 123/568.15, 123/568.17, 568.18
See application file for complete search history.

(56) References Cited

U.S. PATENT DOCUMENTS

| | | | | |
|---|---|---|---|---|
| 3,680,534 | A * | 8/1972 | Chavant | 123/568.17 |
| 6,267,106 | B1 * | 7/2001 | Feucht | 123/568.17 |
| 6,343,594 | B1 * | 2/2002 | Koeslin et al. | 123/568.17 |
| 6,425,382 | B1 * | 7/2002 | Marthaler et al. | 123/568.17 |
| 6,810,725 | B1 * | 11/2004 | Henderson et al. | 73/118.1 |
| 6,880,535 | B1 * | 4/2005 | Sorter et al. | 123/528 |
| 2003/0015596 | A1 * | 1/2003 | Evans | 239/8 |

* cited by examiner

*Primary Examiner*—Mahmoud Gimie
(74) *Attorney, Agent, or Firm*—Elias P. Soupos; Dennis Kelly Sullivan; Susan L. Lukasik

(57) ABSTRACT

A venturi mixing system mixes intake air with exhaust gases for exhaust gas recirculation (EGR) in an internal combustion engine. The venturi mixing system has a venturi disposed in a mixing conduit. The venturi is connected to an intake air conduit and a supply conduit. The venturi and mixing conduit form an annular cavity connected to an EGR conduit. The venturi forms a mixing chamber. One or more inset conduits connect to the venturi and extend into the mixing chamber. Each inset conduit has an end outlet and one or more side outlets. The venturi generates a lower pressure region in the intake air. The inset conduits generate a turbulence field in the lower pressure region. The inset conduits direct intake air into the turbulence field. The inset conduits direct exhaust gases through the end and side outlets into the turbulence field. The exhaust gases mix with the intake air in the turbulence field to form a combustion gas for combustion of fuel in the engine. The venturi provides the combustion gas to the supply conduit.

53 Claims, 6 Drawing Sheets

VENTURI MIXING SYSTEM FOR EXHAUST GAS RECIRCULATION (EGR)

CROSS REFERENCE TO RELATED APPLICATIONS

Rebated applications include the following commonly assigned U.S. patent applications that have been filed on the same day as this application:

U.S. patent application Ser. No. 10/945,591, entitled "Two Stage Mixing System for Exhaust Gas Recirculation (EGR)," and filed on Sep. 21, 2004; and U.S. patent application Ser. No. 10/945,636, entitled "Vortex Mixing System for Exhaust Gas Recirculation (EGR)," and filed on Sep. 21, 2004.

FIELD OF THE INVENTION

This invention generally relates to exhaust gas recirculation (EGR) systems in internal combustion engines. More particularly, this invention relates to EGR systems that have a mixing device to combine exhaust gases with intake air for combustion in the cylinders of an internal combustion engine.

BACKGROUND OF THE INVENTION

Internal combustion engines convert chemical energy from a fuel into mechanical energy. The fuel may be petroleum-based (gasoline or diesel), natural gas, a combination thereof, or the like. Some internal combustion engines, such as gasoline engines, inject an air-fuel mixture into one or more cylinders for ignition by a spark from a spark plug or the like. Other internal combustion engines, such as diesel engines, compress air in the cylinder and then inject fuel into the cylinder for the compressed air to ignite. A diesel engine may use a hydraulically activated electronically controlled unit injection (HEUI) system or the like to control the fuel injection into the cylinders. The ignited fuel generates rapidly expanding gases that actuate a piston in the cylinder. Each piston usually is connected to a crankshaft or similar device for converting the reciprocating motion of the piston into rotational motion. The rotational motion from the crankshaft may be used to propel a vehicle, operate a pump or an electrical generator, or perform other work. The vehicle may be a truck, an automobile, a boat, or the like.

Many internal combustion engines use exhaust gases to reduce the production of nitrogen oxides ($NO_x$) during the combustion process in the cylinders. These internal combustion engines typically mix a portion of the exhaust gases with the intake air for combustion in the cylinders. The exhaust gases usually lower the combustion temperature of the fuel below the temperature where nitrogen combines with oxygen to form $NO_x$.

There are various approaches for mixing the exhaust gases with the intake air in an internal combustion engine. Some internal combustion engines control the opening and closing of exhaust and intake valves in a cylinder. The opening and closing of the valves may trap and push some exhaust gases from the cylinder into the intake manifold for mixing with the intake air. Other internal combustion engines use an exhaust gas recirculation (EGR) system to divert a portion of the exhaust gases exiting the cylinders for mixing with the intake air to the cylinders.

Many EGR systems divert a portion of the exhaust gases from the exhaust manifold to the intake manifold of the engine. The exhaust manifold generally is an accumulation chamber above the cylinders that gathers the exhaust gases for expulsion from the vehicle. The intake manifold generally is another chamber above the cylinders that holds a combustion gas for the cylinders. The combustion gas may be all intake air or a combination of intake air and exhaust gases. The amount of exhaust gases in the combustion gas may vary during engine operation. The internal combustion engine may have a by-pass pipe to supply intake air directly to the intake manifold without exhaust gases.

EGR systems usually have an EGR conduit or pipe connected to the exhaust manifold. The EGR conduit may be a channel formed by the cylinder head or other engine component, a pipe or tube outside the cylinder head, a combination thereof, or the like. The EGR conduit may direct the exhaust gases through a gas trap and a gas cooling device prior to mixing the exhaust gases with the intake air. The gas trap usually is cleaning device for removing particulate from the exhaust gases. The gas cooling device may be a heat exchanger or other device for removing heat from the exhaust gases. The gas cooling device may use coolant from the engine cooling system, a separate cooling system, or a combination thereof. Some EGR systems have an orifice or other pressure measurement device to measure the exhaust gas flow through the EGR conduit.

Many EGR systems may have a control valve connected between the EGR conduit and the exhaust manifold. The engine controller or another microprocessor usually activates the control valve to adjust the flow of exhaust gases through the EGR conduit to achieve a selected concentration of exhaust gases in the intake air. The selected concentration of exhaust gases may vary during engine operation. The control valve may be actuated using a vacuum, a hydraulic fluid such as the hydraulic fluid used in fuel injectors, or the like. Some EGR systems open the control valve only when the pressure of the exhaust gases is higher than the pressure of the intake air. Some EGR systems have a valve in the exhaust duct to restrict the exhaust flow from the engine. The restricted flow increases the back pressure of the exhaust gases. The valve may open or close to control the amount of back pressure and thus may control the flow of exhaust gases into the intake air.

Many EGR systems have a mixing device at the connection of the EGR conduit with the intake conduit that supplies intake air for the cylinders. The intake conduit may be connected to the output of a compressor that pressurizes the intake air. The mixing device typically combines exhaust gases from the EGR conduit with intake air from the intake conduit to form the combustion gas for the cylinders. During engine operation, the exhaust gases usually flow into the intake air when the pressure of the exhaust gases is greater than the pressure of the intake air. The intake air pressure may vary especially when a turbocharger is used.

The mixing device typically is a pipe or other union between the EGR conduit and the intake conduit. The EGR and intake conduits may form a "tee" or similar connection. The mixing device may form a mixing chamber. The EGR conduit and/or intake conduit may expand to form the mixing chamber at the connection. The mixing device mixes the exhaust gases with the intake air to form the combustion gas. The mixing device usually supplies the combustion gas to the intake manifold through a supply pipe or conduit.

The mixing device may have an EGR conduit that extends into the intake conduit. The EGR conduit may create an obstacle that separates the intake air into two streams, each passing on an opposite side of the EGR conduit. The exhaust gas exits the EGR conduit and enters into a region of the mixing device where the two streams are essentially absent.

The two intake air streams combine with each other and with the exhaust gases downstream from the EGR conduit.

The mixing device may have a venturi for combining the exhaust gases with the intake air. The venturi typically forms part of the intake conduit. The venturi usually has an inlet connected to an outlet by a nozzle or throat. The inlet and outlet have larger diameters than the throat. The diameter of the intake conduit tapers down from the inlet to the throat and then tapers up from the throat to the outlet. The EGR conduit connects to the throat. The inlet may be connected to the compressor output of a turbocharger. The outlet is connected to the supply conduit for providing the combustion gas to the intake manifold.

In operation, the venturi creates a pressure drop in the intake air passing through the throat. The smaller diameter of the throat increases the velocity of the intake air. The increase in velocity lowers the pressure of the intake air in throat. The lower pressure of the intake air increases the amount of exhaust gases that can enter the throat for mixing with the intake air to form the combustion gas. At the outlet, the larger diameter decreases the velocity of the combustion gas. The decrease in velocity increases the pressure of the combustion gas.

Many mixing devices may not adequately blend the intake air with the exhaust gases to form a combustion gas with an essentially uniform dispersion of the exhaust gases in the intake air. While the exhaust gases and intake air are combined, there may be an uneven dispersion of the exhaust gases in the intake air. The uneven dispersion may include pockets, zones, regions, or strata of higher or lower concentrations of exhaust gases than the selected concentration of exhaust gases in the intake air. The dispersion may be more uneven when the exhaust gases enter on one side of the intake air stream. The selected concentration of exhaust gases in the intake air may be reduced to avoid or reduce the effects of the uneven dispersion on engine operation. Internal combustion engines may produce more $NO_x$ at the lower selected concentrations of exhaust gases in the intake air.

SUMMARY

This invention provides a venturi mixing system for exhaust gas recirculation (EGR) in an internal combustion engine. The venturi mixing system directs exhaust gases and intake air into a turbulence field generated in a lower pressure region of the intake air. The exhaust gases mix with the intake air in the turbulence field.

A venturi mixing system for exhaust gas recirculation (EGR) in an internal combustion engine may have a venturi mixing device connected to an intake air conduit, a supply conduit, and an EGR conduit. The venturi mixing device generates a lower pressure region in intake air from the intake air conduit. The venturi mixing device generates a turbulence field in the lower pressure region. The venturi mixing device directs exhaust gases from the EGR conduit into the turbulence field. The venturi mixing device provides a combustion gas to the supply conduit.

A venturi mixing system for exhaust gas recirculation (EGR) in an internal combustion engine may have a mixing conduit, a venturi, an intake air conduit, a supply conduit, an EGR conduit, and one or more inset conduits. The venturi is disposed in the mixing conduit. The venturi and the mixing conduit form an annular cavity. The venturi forms a mixing chamber. The venturi is connected to the intake air conduit and the supply conduit. The EGR conduit is connected to the annular cavity. The one or more inset conduits are connected to the venturi. Each inset conduit extends into the mixing chamber. Each inset conduit forms an end outlet. Each inset conduit forms one or more side outlets on a downstream side.

A venturi mixing device for exhaust gas recirculation (EGR) in an internal combustion engine may have a mixing conduit, a venturi, and one or more inset conduits. The venturi is disposed in the mixing conduit. The venturi and the mixing conduit form an annular cavity. The venturi forms a mixing chamber. The venturi has an inlet section connected by a throat section to an outlet section. The inlet section forms a venturi inlet. The inlet section has an inlet length from the throat section to the venturi inlet. The venturi inlet has a venturi inlet diameter. The throat section has a throat diameter. The outlet section forms a venturi outlet. The outlet section has an outlet length from the throat section to the venturi outlet. The one or more inset conduits are connected to the venturi. Each inset conduit extends into the mixing chamber. The inset conduits have an inset diameter. Each inset conduit forms an end outlet at an offset distance from an axis of the mixing chamber. The end outlet has a guide angle with the axis. The inset conduit forms one or more side outlets on a downstream side.

In a method for mixing exhaust gases with intake air in an internal combustion engine, a lower pressure region is generated in intake air. A turbulence field is generated in the lower pressure region. Exhaust gases are directed into the turbulence field.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
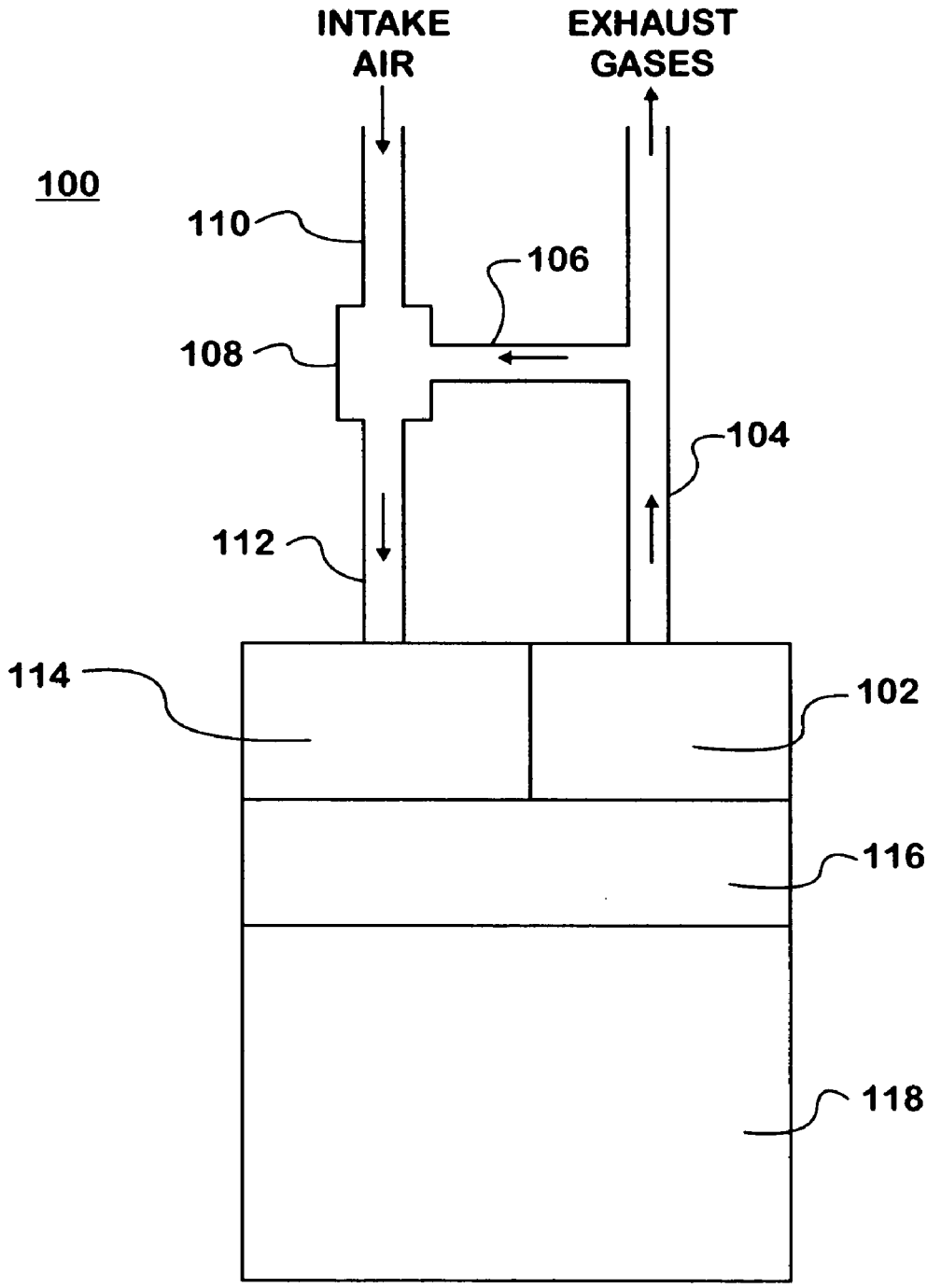
FIG. 1 is a schematic view of a venturi mixing system for exhaust gas recirculation (EGR) on an internal combustion engine.

FIG. 1 is a schematic view of an internal combustion engine 100 with a venturi mixing system for exhaust gas recirculation (EGR). Exhaust gases from the internal combustion engine 100 flow through an exhaust manifold 102 into an exhaust conduit 104. The internal combustion engine 100 diverts a portion of the exhaust gases from the exhaust conduit 104 through an exhaust gas recirculation (EGR) conduit 106 into a venturi mixing device 108. Intake air for the combustion of fuel in the internal combustion engine 100 flows through an intake air conduit 110 into the venturi mixing device 108. The venturi mixing device 108 generates a lower pressure region in the intake air and generates a turbulence field in the lower pressure zone. The venturi mixing device 108 directs the exhaust gases into the turbulence field and directs intake air into the turbulence field. The exhaust gases mix with the intake air in the turbulence field to form a combustion gas for the combustion of fuel in the internal combustion engine 100. The combustion gas flows from the venturi mixing device 108 through a supply conduit 112 into the intake manifold 114 of the internal combustion engine 100. While a particular configuration is shown, the internal combustion engine 100 with a venturi mixing system may have other configurations including those with additional components.

The internal combustion engine 100 has a cylinder head 116 connected to a crankcase 118. The exhaust manifold 102 and the intake manifold 114 are disposed adjacent to the cylinder head 116. The crankcase 118 forms one or more cylinders (not shown) arranged in an in-line, Vee, or other configuration. There may be multiple cylinder heads each with intake and exhaust manifolds such as when the cylinders are arranged in separate banks as in Vee or like configurations. During engine operation, the combustion gas flows from the intake manifold 114 into the cylinders. The combustion gas may comprise all intake air or a mixture of intake air and exhaust gases. The combustion gas may have a selected concentration of exhaust gases in the intake air. Selected concentration includes the percentage of exhaust gases in the combustion gas, a ratio of the amount of exhaust gases to the amount of intake air, or the like. The selected concentration may vary during engine operation. The combustion gas ignites fuel in the cylinders. The exhaust gases from the combustion of fuel flow from the cylinders into the exhaust manifold 102.

The exhaust manifold 102 connects to the exhaust conduit 104. The EGR conduit 106 connects the exhaust conduit 104 to the venturi mixing device 108. The EGR conduit 106 may have other components such as a gas cooler (not shown) and a gas trap (not shown). A control valve (not shown) may connect the EGR conduit 106 to the exhaust conduit 104. An engine controller (not shown) may operate the control valve to provide the selected concentration of exhaust gases in the combustion gas.

The venturi mixing device 108 is connected to the intake air conduit 110. The supply conduit 112 connects the venturi mixing device 108 to the intake manifold 114. The internal combustion engine 100 may have an intake air bypass (not shown) connecting the intake air conduit 110 directly to the supply conduit 112. The intake air bypass may provide intake air directly to the intake manifold 114 without exhaust gases.

The internal combustion engine 100 may have a turbocharger (not shown). The exhaust conduit 104 may connect to the turbine inlet of the turbocharger. The intake air conduit 110 may connect to the compressor outlet of the turbocharger.

During operation of the internal combustion engine 100, exhaust gases flow through the exhaust manifold 102 into the exhaust conduit 104. A portion of the exhaust gases is diverted through the EGR conduit 106 and into the venturi mixing device 108. The remaining exhaust gases may pass through the turbine of a turbocharger or another engine component prior to exiting. The intake air flows through the intake air conduit 110 into the venturi mixing device 108 for mixing with the exhaust gases from the EGR conduit 106. The venturi mixing device 108 generates a lower pressure region in the intake air. The venturi mixing device 108 constricts the flow and thus increases the velocity of the intake air. The increased velocity decreases the pressure of the intake air to form the lower pressure region. The venturi mixing device 108 generates a turbulence field in the lower pressure region. The turbulence field includes one or more turbulent flow locations where the intake air has irregular local velocities and pressures. The turbulent flow locations may be separate or next to each other. The turbulent flow locations may form one or more vortices. The venturi mixing device 108 directs exhaust gases into the turbulence field. The venturi mixing device 108 also directs intake air into the turbulence field. The exhaust gases mix with the intake air in the turbulence field to form the combustion gas. The combustion gas flows from the venturi mixing device 108 through the supply conduit 112 into the intake manifold 114 of the internal combustion engine 100.

Figure 3:
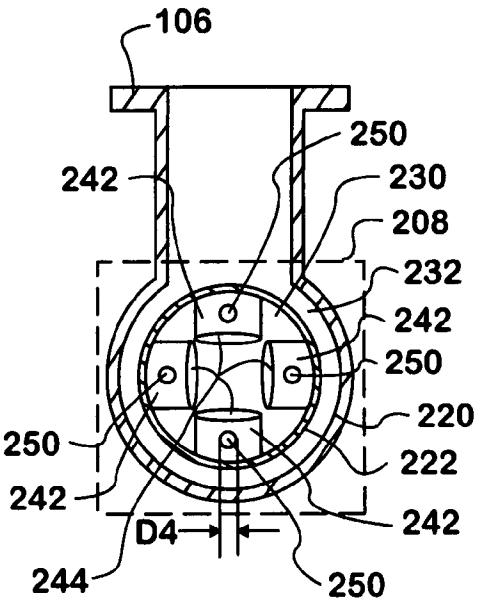
FIG. 3 is an end cross-section view of the venturi mixing device of FIG. 2.
Figure 2:
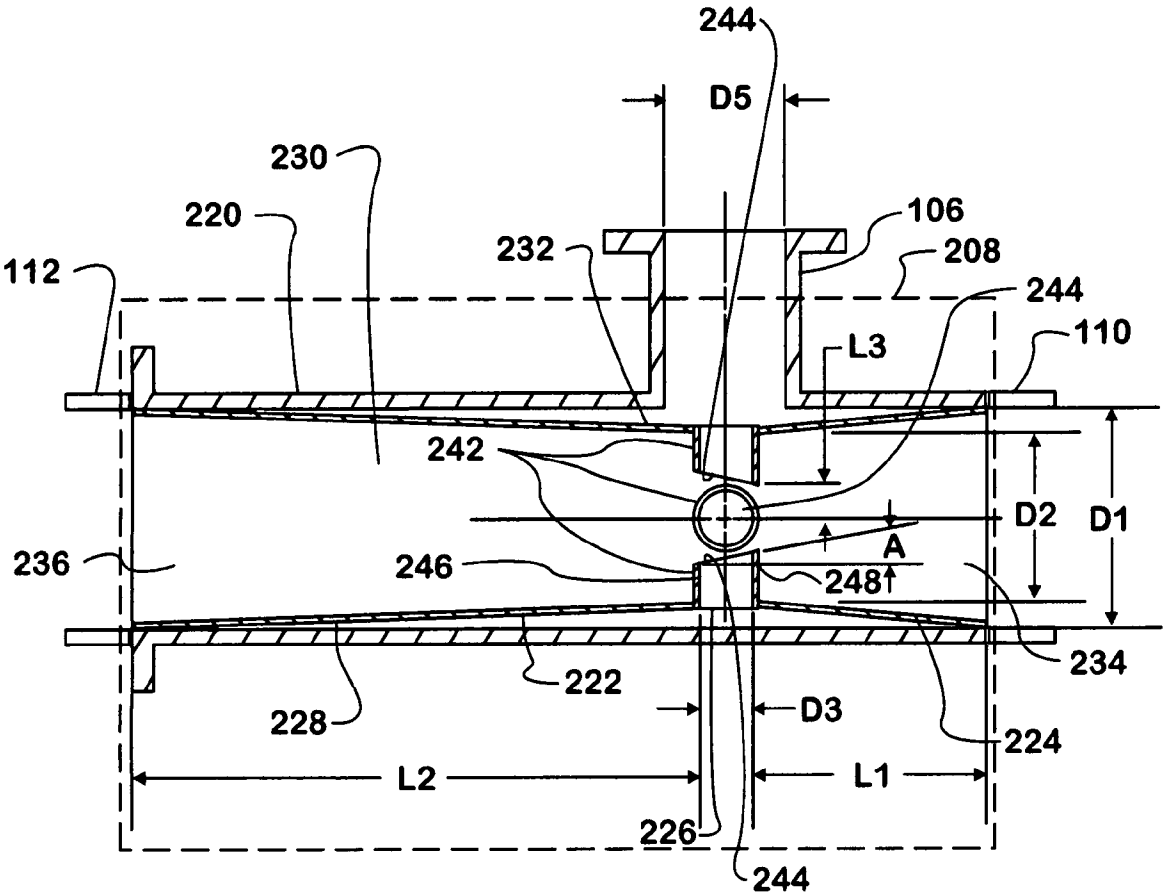
FIG. 2 is a side cross-section view of a venturi mixing device for the venturi mixing system of FIG. 1.

FIGS. 2–3 are cross-section views of a venturi mixing device 208 for a venturi mixing system. The venturi mixing device 208 has a mixing conduit 220 that connects to the EGR conduit 106, the intake air conduit 110, and the supply conduit 112. The mixing conduit 220 has essentially the same inside diameter as the intake air conduit 110 and the supply conduit 112. The mixing conduit 220 may be part or an extension of the intake air conduit 110, the supply conduit 112, or a combination thereof. The mixing conduit 220, the intake air conduit 110, and the supply conduit 112 may be the same component.

A venturi 222 is disposed inside the mixing conduit 220. The venturi 222 may be a machined component, a press metal sleeve, or the like. The venturi 222 has an inlet section 224 connected by a throat section 226 to an outlet section 228. The inlet section 224 connects with the mixing conduit 220 at or near the connection with the air intake conduit 110. The outlet section 228 connects with the mixing conduit 220 at or near the connection with the supply conduit 112. The venturi 222 and the mixing conduit 220 form an annular cavity 232. The venturi 222 forms a mixing chamber 230 having an axis or centerline.

The inlet section 224 forms a venturi inlet 234 at or near the connection with the air intake conduit 110. The inlet section 224 has an inlet length, L1, from the connection with the throat section 226 to the venturi inlet 234. The venturi inlet 234 has a venturi inlet diameter, D1. The inlet section 224 tapers down or reduces diameter from the venturi inlet 234 to the throat section 226. The throat section 226 has a throat diameter, D2. The ratio of the throat diameter to the venturi inlet diameter, D2:D1, may be greater than about 0.45 and less than about 0.95. The ratio of D2:D1 may be about 0.71. Other ratios of D2:D1 may be used. The ratio of the inlet length to the venturi inlet diameter, L1:D1, may be greater than about 0.5 and less than about 2.0. The ratio of L1:D1 may be about 1.0. Other ratios of L1:D1 may be used.

The outlet section 228 forms a venturi outlet 236 at or near the connection with the supply conduit 112. The venturi outlet 236 has essentially the same diameter as the venturi inlet 234. The outlet section 228 tapers up or increases diameter from the throat section 226 to the venturi outlet 236. The outlet section 228 has an outlet length, L2, from the connection with the throat section 226 to the venturi outlet 236. The ratio of the outlet length to the venturi inlet diameter, L2:D1, may be greater than about 1.5 and less than about 5.0. The ratio of L2:D1 may be about 2.5. Other ratios of L2:D1 may be used.

One or more inset conduits 242 are connected to the throat section 226. The inset conduits 242 extend radially into the mixing chamber 230. The inset conduits 242 may be perpendicular or at angle to the throat section 226. Multiple inset conduits 242 may be positioned equidistantly from each other along the circumference of the throat section. The throat section 226 may have four inset conduits 242 that are equidistant from each other and extend radially into the mixing chamber 230. Other numbers and positions of the inset conduits 242 may be used. The inset conduits 242 may have other orientations and arrangements.

The inset conduits 242 each may have a cylindrical configuration with one end connected to the annular cavity 232. Each inset conduit 242 forms an end outlet 244 on the other end. The end outlet 244 produces a flow surface between exhaust gases in the inset conduit 242 and intake air in the mixing chamber 230. A cylindrical configuration includes a circular or like cross-section. The inset conduits 242 may have other configurations. Each inset conduit 242 positions the end outlet 244 and thus the flow surface at an offset distance, L3, from the axis of the mixing chamber 230. The offset distance, L3, is essentially the minimum distance of the end outlet 244 and the flow surface from the axis of the mixing chamber 230. Each inset conduit 242 has an inset diameter, D3. The ratio of the offset distance to the inset diameter, L3:D3, may be greater than about 1.0 and less than about 1.5. The ratio of L3:D3 may be about 1.1. Other ratios of L3:D3 may be used. The ratio of the inset diameter to the venturi inlet diameter, D3:D1, may be greater than about 0.125 and less than about 0.55. The ratio of D3:D1 may be about 0.25. Other ratios of D3:D1 may be used. The flow surface may have a planar, curvilinear, a combination thereof, or like configuration. Curvilinear includes convex, concave, and the like. The end outlet 244 and the flow surface have a guide angle, A, with the axis of the mixing chamber 230. The guide angle, A, may be equal to or greater than about zero. The guide angle, A, may be less than about 45 degrees. Other guide angles may be used.

Each inset conduit 242 has a downstream side 246 opposite an upstream side 248. The downstream side 246 faces the venturi outlet 236 and faces the connection of the supply conduit 112 with the mixing conduit 220. The upstream side 248 faces the venturi inlet 234 and faces the connection of the intake air conduit 110 with the mixing conduit 220.

The inset conduits 242 form one or more side outlets on the downstream sides 230. Each inset conduit 242 may have one or more side outlets. The side outlets are openings into the inset conduits 242 that direct the flow of exhaust gases into the mixing chamber 230. The side outlets may have different shapes.

The side outlets may be orifices 250, which may be circular, angular, rectangular, a combination thereof, or the like. The inset conduits 242 may have four or another number of orifices 250. The location of the inset conduits 242 and the location of the orifices 250 on the inset conduits 242 may position the orifices 250 substantially equidistant from each other. Other arrangements of the orifices 250 may be used. The orifices 250 may have an orifice diameter, D4. The ratio of the orifice diameter to the venturi inlet diameter, D4:D1, may be greater than about 0.025 and less than about 0.25. The ratio of D4:D1 may be about 0.12. Other ratios of D4:D1 may be used.

The EGR conduit 106 connects to the annular cavity 232 formed by the mixing conduit 220 and the venturi 222. The EGR conduit 106 may connect to the annular cavity 232 near the throat section 226. The EGR conduit 106 may be aligned with the inset conduits 242. The EGR conduit 106 has an EGR conduit diameter, D5. The ratio of the EGR conduit diameter to the venturi inlet diameter, D5:D1, may be greater than about 0.25 and less than about 0.75. The ratio of D5:D1 may be about 0.5. Other ratios of D5:D1 may be used.

In operation, exhaust gases mix with intake air in the mixing chamber 230 of the venturi 222. The exhaust gases flow from the EGR conduit 106 into the annular cavity 232 formed by the mixing conduit 220 and the venturi 222. The exhaust gases flow from the annular cavity 232 into the inset conduits 242. The annular cavity 232 may substantially equalize the pressure and flow of exhaust gases into the inset conduits 242. The exhaust gases flow from the inset conduits 242 through the end outlets 244 and the orifices 250 into the mixing chamber 230. The intake air flows from the intake air conduit 110 through the venturi inlet 234 into the mixing chamber 230. The intake air has a normal pressure in the intake air conduit 110.

In the mixing chamber 230, the venturi 222 generates a lower pressure region in the intake air. The intake air flows from the venturi inlet 234 through the inlet section 224 into the throat section 226. The inlet section 224 constricts the flow and thus increases the velocity of the intake air. As the velocity increases, the pressure of the intake air decreases. In the throat section 226, the intake air reaches a maximum velocity and a minimum pressure. In the outlet section 228, the velocity decreases and the pressure increases. The lower pressure region includes locations where the pressure of intake air is lower than the normal pressure. The lower pressure region may have a minimum pressure zone where the pressure of the intake air is essentially the minimum pressure.

The venturi 222 generates a turbulence field in the lower pressure region. As intake air flows through the throat section 226, the intake air engages and flows around the inset conduits 242. On each inset conduit 242, the intake air forms a boundary layer along the surface of the upstream side 248. The pressure at the boundary layer decreases gradually as intake air moves from the upstream side 248 toward the downstream side 246. The boundary layer stays attached to the inset conduit 242 while the pressure decreases. As intake air moves along the downstream side 246 away from the upstream side 248, the pressure at the boundary layer increases. The increasing pressure on the downstream side 246 may cause the boundary layer to separate from the inset conduit 242. As the boundary layer separates, the intake air forms turbulent flow locations near the downstream side 246. The flow surface may generate turbulent flow locations in the intake air. In the turbulent flow locations, the intake air has irregular local velocities and pressures. The intake air may form one or more vortices in the turbulent flow locations. A vortex is a mass of swirling intake air that draws exhaust gases and/or other intake air toward the center of the vortex. Each inset conduit 242 may generate one or more turbulent flow locations near the downstream side 246. The turbulence field includes the turbulent flow locations.

The inset conduits 242 may direct intake air into the turbulence field. The flow surface on each inset conduit 242 may direct intake air passing the flow surface into the turbulent flow locations. The guide angle, A, may be selected to direct intake air into the turbulent flow locations. The intake air flowing past the flow surfaces may have different flow directions than the intake air flowing around the inset conduits 242. The combination of intake air with different flow directions may increase the number, size, and/or intensity of the turbulent flow locations. The intake air flowing past the flow surfaces may have different pressures and velocities than intake air flowing around the inset conduits 242. The different pressures and velocities of the intake air may increase the number, size, and/or intensity of the turbulent flow locations.

The inset conduits 242 direct the exhaust gases into the turbulence field. The exhaust gases flow through the end outlets 244 and the orifices 250 into the turbulent flow locations near the downstream sides 246 of the inset conduits 242. The exhaust gases mix with the intake air in the turbulence field to form the combustion gas for the cylinders in the engine. The combustion gas flows from the mixing chamber 230 into the supply conduit 112.

Figure 5:
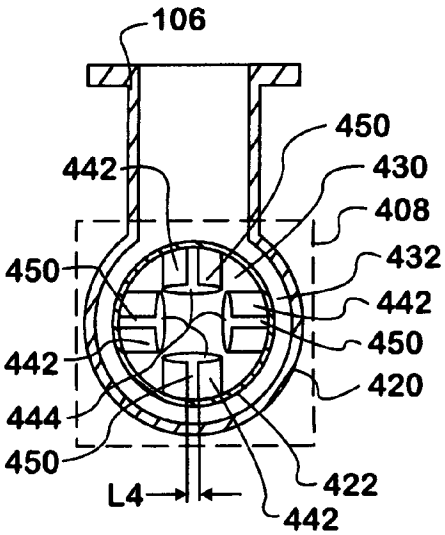
FIG. 5 is an end cross-section view of the venturi mixing device of FIG. 4.
Figure 4:
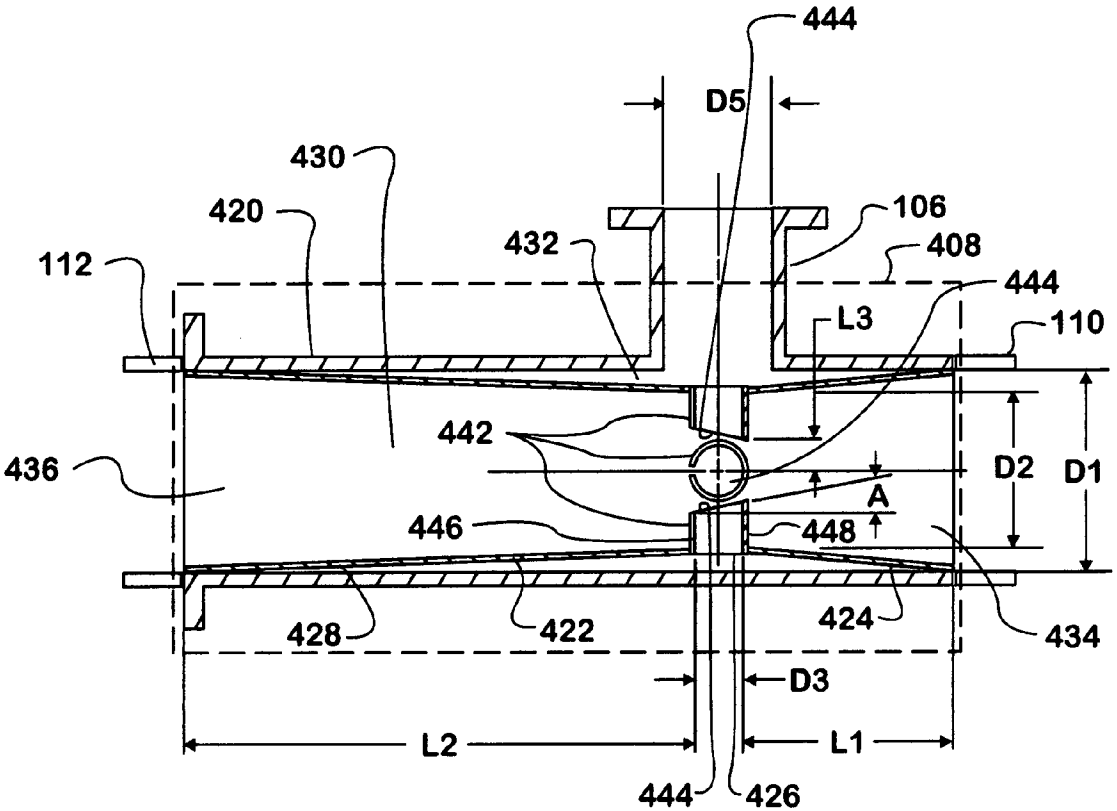
FIG. 4 is a side cross-section view of another venturi mixing device for the venturi mixing system of FIG. 1.

FIGS. 4–5 are cross-section views of another venturi mixing device 408 for a venturi mixing system. The venturi mixing device 408 is substantially the same as the venturi mixing device 208 except for the configuration of the side outlets. The venturi mixing device 408 has a mixing conduit 420 that connects to the EGR conduit 106, the intake air conduit 110, and the supply conduit 112. The mixing conduit 420 has essentially the same inside diameter as the intake air conduit 110 and the supply conduit 112. The mixing conduit 420 may be part or an extension of the intake air conduit 110, the supply conduit 112, or a combination thereof. The mixing conduit 420, the intake air conduit 110, and the supply conduit 112 may be the same component.

A venturi 422 is disposed inside the mixing conduit 420. The venturi 422 may be a machined component, a press metal sleeve, or the like. The venturi 422 has an inlet section 424 connected by a throat section 426 to an outlet section 428. The inlet section 424 connects with the mixing conduit 420 at or near the connection with the air intake conduit 110. The outlet section 428 connects with the mixing conduit 420 at or near the connection with the supply conduit 112. The venturi 422 and the mixing conduit 420 form an annular cavity 432. The venturi 422 forms a mixing chamber 430 having an axis or centerline.

The inlet section 424 forms a venturi inlet 434 at or near the connection with the air intake conduit 110. The inlet section 424 has an inlet length, L1, from the connection with the throat section 426 to the venturi inlet 434. The venturi inlet 434 has a venturi inlet diameter, D1. The inlet section 424 tapers down or reduces diameter from the venturi inlet 434 to the throat section 426. The throat section 426 has a throat diameter, D2. The ratio of the throat diameter to the venturi inlet diameter, D2:D1, may be greater than about 0.45 and less than about 0.95. The ratio of D2:D1 may be about 0.71. Other ratios of D2:D1 may be used. The ratio of the inlet length to the venturi inlet diameter, L1:D1, may be greater than about 0.5 and less than about 2.0. The ratio of L1:D1 may be about 1.0. Other ratios of L1:D1 may be used.

The outlet section 428 forms a venturi outlet 436 at or near the connection with the supply conduit 112. The venturi outlet 436 has essentially the same diameter as the venturi inlet 434. The outlet section 428 tapers up or increases diameter from the throat section 426 to the venturi outlet 436. The outlet section 428 has an outlet length, L2, from the connection with the throat section 426 to the venturi outlet 436. The ratio of the outlet length to the venturi inlet diameter, L2:D1, may be greater than about 1.5 and less than about 5.0. The ratio of L2:D1 may be about 2.5. Other ratios of L2:D1 may be used.

One or more inset conduits 442 are connected to the throat section 426. The inset conduits 442 extend radially into the mixing chamber 430. The inset conduits 442 may be perpendicular or at angle to the throat section 426. Multiple inset conduits 442 may be positioned equidistantly from each other along the circumference of the throat section. The throat section 426 may have four inset conduits 442 that are equidistant from each other and extend radially into the mixing chamber 430. Other numbers and positions of the inset conduits 442 may be used. The inset conduits 442 may have other orientations and arrangements.

The inset conduits 442 each may have a cylindrical configuration with one end connected to the annular cavity 432. Each inset conduit 442 forms an end outlet 444 on the other end. The end outlet 442 produces a flow surface between exhaust gases in the inset conduit 442 and intake air in the mixing chamber 430. A cylindrical configuration includes a circular or like cross-section. The inset conduits 442 may have other configurations. Each inset conduit 442 positions the end outlet 444 and thus the flow surface at an offset distance, L3, from the axis of the mixing chamber 430. The offset distance, L3, is essentially the minimum distance of the end outlet 444 and the flow surface from the axis of the mixing chamber 430. Each inset conduit 442 has an inset diameter, D3. The ratio of the offset distance to the inset diameter, L3:D3, may be greater than about 1.0 and less than about 1.5. The ratio of L3:D3 may be about 1.1. Other ratios of L3:D3 may be used. The ratio of the inset diameter to the venturi inlet diameter, D3:D1, may be greater than about 0.125 and less than about 0.55. The ratio of D3:D1 may be about 0.25. Other ratios of D3:D1 may be used. The flow surface may have a planar, curvilinear, a combination thereof, or like configuration. Curvilinear includes convex, concave, or the like. The end outlet 444 and the flow surface have a guide angle, A, with the axis of the mixing chamber 430. The guide angle, A, may be equal to or greater than about zero. The guide angle, A, may be less than about 45 degrees. Other guide angles may be used.

Each inset conduit 442 has a downstream side 446 opposite an upstream side 448. The downstream side 446 faces the venturi outlet 436 and faces the connection of the supply conduit 112 with the mixing conduit 420. The upstream side 448 faces the venturi inlet 434 and faces the connection of the intake air conduit 110 with the mixing conduit 420.

The inset conduits 442 form one or more side outlets on the downstream sides 430. Each inset conduit 442 may have one or more side outlets. The side outlets are openings into the inset conduits 442 that direct the flow of exhaust gases into the mixing chamber 430. The side outlets may have different shapes.

The side outlets may be slots 450, which may have a narrow rectangular or like configuration. A narrow rectangular configuration may have two longer sides in parallel adjacent to two shorter sides opposite each other. The shorter sides may have an essentially straight or circular shape. The shorter sides may be convex, concave, or a combination thereof. The inset conduits 442 may have four or another number of slots 450. The location of the inset conduits 442 and the location of the slots 450 on the inset conduits 442 may position the slots 450 substantially equidistant from each other. Other arrangements of the slots 450 may be used. The slots 450 may have a slot width, L4. The ratio of the slot width to the inset diameter, L4:D3, may be greater than about 0.2 and less than about 0.9. The ratio of L4:D3 may be about 0.25. Other ratios of L4:D3 may be used.

The EGR conduit 106 connects to the annular cavity 432 formed by the mixing conduit 420 and the venturi 422. The EGR conduit 106 may connect to the annular cavity 432 near the throat section 426. The EGR conduit 106 may be aligned with the inset conduits 442. The EGR conduit 106 has an EGR conduit diameter, D5. The ratio of the EGR conduit diameter to the venturi inlet diameter, D5:D1, may be greater than about 0.25 and less than about 0.75. The ratio of D5:D1 may be about 0.5. Other ratios of D5:D1 may be used.

In operation, exhaust gases mix with intake air in the mixing chamber 430 of the venturi 422. The exhaust gases flow from the EGR conduit 106 into the annular cavity 432 formed by the mixing conduit 420 and the venturi 422. The exhaust gases flow from the annular cavity 432 into the inset conduits 442. The annular cavity 432 may substantially equalize the pressure and flow of exhaust gases into the inset conduits 442. The exhaust gases flow from the inset conduits 442 through the end outlets 444 and the slots 450 into the mixing chamber 430. The intake air flows from the intake air conduit 110 through the venturi inlet 434 into the mixing chamber 430. The intake air has a normal pressure in the intake air conduit 110.

In the mixing chamber 430, the venturi 422 generates a lower pressure region in the intake air. The intake air flows from the venturi inlet 434 through the inlet section 424 into the throat section 426. The inlet section 424 constricts the flow and thus increases the velocity of the intake air. As the velocity increases, the pressure of the intake air decreases. In the throat section 426, the intake air reaches a maximum velocity and a minimum pressure. In the outlet section 428, the velocity decreases and the pressure increases. The lower pressure region includes locations where the pressure of intake air is lower than the normal pressure. The lower pressure region may have a minimum pressure zone where the pressure of the intake air is essentially the minimum pressure.

The venturi 422 generates a turbulence field in the lower pressure region. As intake air flows through the throat section 426, the intake air engages and flows around the inset conduits 442. On each inset conduit 442, the intake air forms a boundary layer along the surface of the upstream side 448. The pressure at the boundary layer decreases gradually as intake air moves from the upstream side 448 toward the downstream side 446. The boundary layer stays attached to the inset conduit 442 or 428 while the pressure decreases. As intake air moves along the downstream side 446 away from the upstream side 448, the pressure at the boundary layer increases. The increasing pressure on the downstream side 446 may cause the boundary layer to separate from the inset conduit 442. As the boundary layer separates, the intake air forms turbulent flow locations near the downstream side 446. The flow surface may generate turbulent flow locations in the intake air. In the turbulent flow locations, the intake air has irregular local velocities and pressures. The intake air may form one or more vortices in the turbulent flow locations. A vortex is a mass of swirling intake air that draws exhaust gases and/or other intake air toward the center of the vortex. Each inset conduit 442 may generate one or more turbulent flow locations near the downstream side 446. The turbulence field includes the turbulent flow locations.

The inset conduits 442 may direct intake air into the turbulence field. The flow surface on each inset conduit 442 may direct intake air passing the flow surface into the turbulent flow locations. The guide angle, A, may be selected to direct intake air into the turbulent flow locations. The intake air flowing past the flow surfaces may have different flow directions than the intake air flowing around the inset conduits 442. The combination of intake air with different flow directions may increase the number, size, and/or intensity of the turbulent flow locations. The intake air flowing past the flow surfaces may have different pressures and velocities than intake air flowing around the inset conduits 442. The different pressures and velocities of the intake air may increase the number, size, and/or intensity of the turbulent flow locations.

The inset conduits 442 direct the exhaust gases into the turbulence field. The exhaust gases flow through the end outlets 444 and the slots 450 into the turbulent flow locations near the downstream sides 446 of the inset conduits 442. The exhaust gases mix with the intake air in the turbulence field to form the combustion gas for the cylinders in the engine. The combustion gas flows from the mixing chamber 430 into the supply conduit 112.

Figure 7:
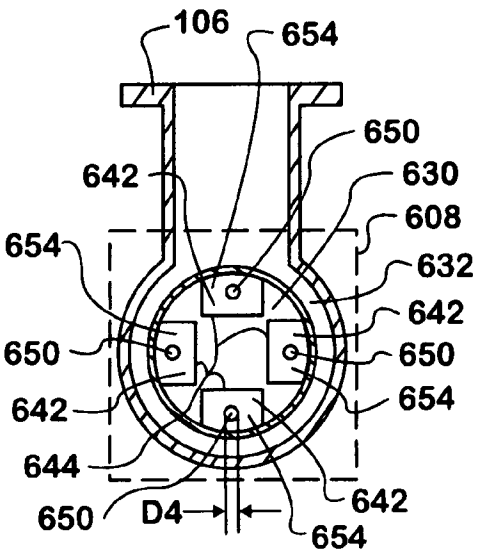
FIG. 7 is an end cross-section view of the venturi mixing device of FIG. 6.
Figure 6:
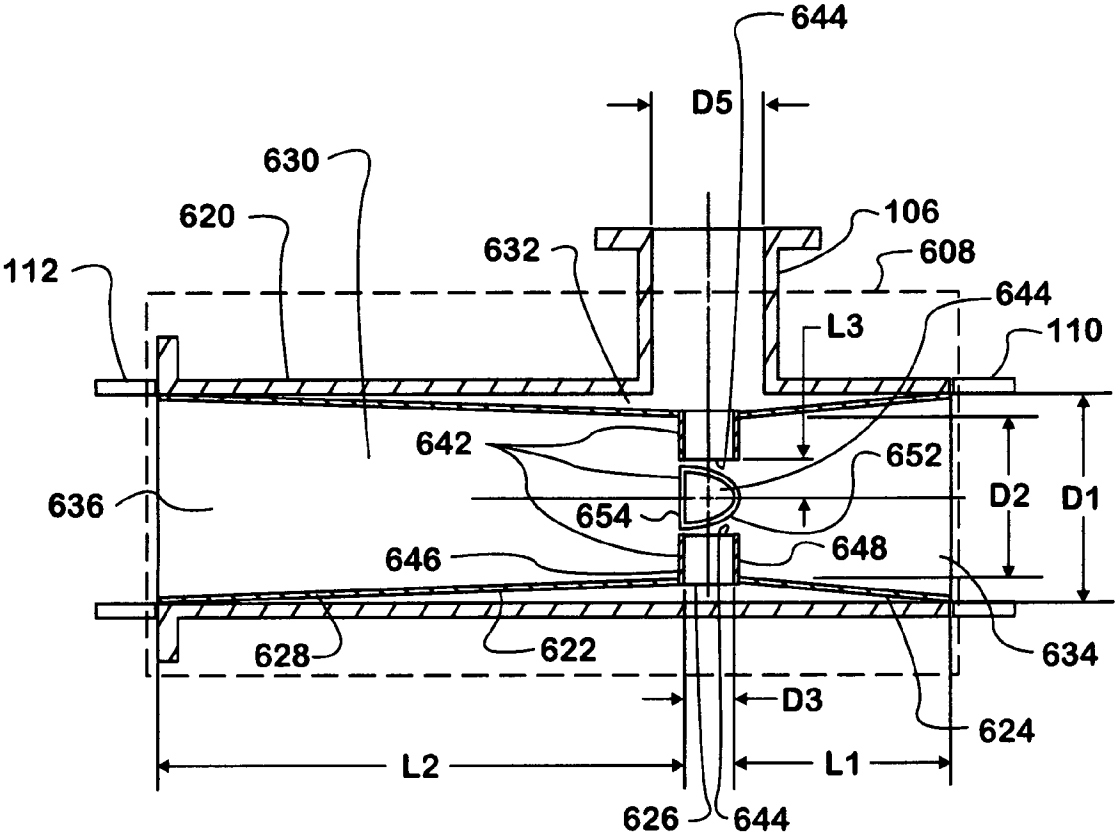
FIG. 6 is a side cross-section view of an additional venturi mixing device for the venturi mixing system of FIG. 1.

FIGS. 6–7 are cross-section views of an additional venturi mixing device 608 for a venturi mixing system. The venturi mixing device 608 is substantially the same as the venturi mixing device 208 except for the configuration of the inset conduits. The venturi mixing device 608 has a mixing conduit 620 that connects to the EGR conduit 106, the intake air conduit 110, and the supply conduit 112. The mixing conduit 620 has essentially the same inside diameter as the intake air conduit 110 and the supply conduit 112. The mixing conduit 620 may be part or an extension of the intake air conduit 110, the supply conduit 112, or a combination thereof. The mixing conduit 620, the intake air conduit 110, and the supply conduit 112 may be the same component.

A venturi 622 is disposed inside the mixing conduit 620. The venturi 622 may be a machined component, a press metal sleeve, or the like. The venturi 622 has an inlet section 624 connected by a throat section 626 to an outlet section 628. The inlet section 624 connects with the mixing conduit 620 at or near the connection with the air intake conduit 110. The outlet section 628 connects with the mixing conduit 620 at or near the connection with the supply conduit 112. The venturi 622 and the mixing conduit 620 form an annular cavity 632. The venturi 622 forms a mixing chamber 630 having an axis or centerline.

The inlet section 624 forms a venturi inlet 634 at or near the connection with the air intake conduit 110. The inlet section 624 has an inlet length, L1, from the connection with the throat section 626 to the venturi inlet 634. The venturi inlet 634 has a venturi inlet diameter, D1. The inlet section 624 tapers down or reduces diameter from the venturi inlet 634 to the throat section 626. The throat section 626 has a throat diameter, D2. The ratio of the throat diameter to the venturi inlet diameter, D2:D1, may be greater than about 0.45 and less than about 0.95. The ratio of D2:D1 may be about 0.71. Other ratios of D2:D1 may be used. The ratio of the inlet length to the venturi inlet diameter, L1:D1, may be greater than about 0.5 and less than about 2.0. The ratio of L1:D1 may be about 1.0. Other ratios of L1:D1 may be used.

The outlet section 628 forms a venturi outlet 636 at or near the connection with the supply conduit 112. The venturi outlet 636 has essentially the same diameter as the venturi inlet 634. The outlet section 628 tapers up or increases diameter from the throat section 626 to the venturi outlet 636. The outlet section 628 has an outlet length, L2, from the connection with the throat section 626 to the venturi outlet 636. The ratio of the outlet length to the venturi inlet diameter, L2:D1, may be greater than about 1.5 and less than about 5.0. The ratio of L2:D1 may be about 2.5. Other ratios of L2:D1 may be used.

One or more inset conduits 642 are connected to the throat section 626. The inset conduits 642 extend radially into the mixing chamber 630. The inset conduits 642 may be perpendicular or at angle to the throat section 626. Multiple inset conduits 642 may be positioned equidistantly from each other along the circumference of the throat section. The throat section 626 may have four inset conduits 642 that are equidistant from each other and extend radially into the mixing chamber 630. Other numbers and positions of the inset conduits 642 may be used. The inset conduits 642 may have other orientations and arrangements.

The inset conduits 642 each have a downstream side 646 opposite an upstream side 648. The downstream side 646 faces the venturi outlet 636 and faces the connection of the supply conduit 112 with the mixing conduit 620. The upstream side 648 faces the venturi inlet 634 and faces the connection of the intake air conduit 110 with the mixing conduit 620.

Each inset conduit 642 may have an airfoil configuration with one end connected to the annular cavity 632. Each inset conduit 642 forms an end outlet 644 on the other end. The end outlet 644 produces a flow surface between exhaust gases in the inset conduit 642 and intake air in the mixing chamber 630. The airfoil configuration may have a curved surface 652 connected to a flat surface 654. The curved surface 652 includes parabolic, elliptical, a combination thereof, or like cross-sections. The flat surface 654 may be essentially flat, essentially planar, or the like. The upstream side 648 of the inset conduit 642 forms the curved surface 652. The downstream side 646 forms the flat surface 654. The airfoil configuration may reduce the air flow drag across the inset conduit 242. The inset conduit 642 may have other configurations.

Each inset conduit 642 positions the end outlet 644 and thus the flow surface at an offset distance, L3, from the axis of the mixing chamber 630. The offset distance, L3, is essentially the minimum distance of the end outlet 644 and the flow surface from the axis of the mixing chamber 630. Each inset conduit 642 has an inset diameter, D3. The ratio of the offset distance to the inset diameter, L3:D3, may be greater than about 1.0 and less than about 1.5. The ratio of L3:D3 may be about 1.1. Other ratios of L3:D3 may be used. The ratio of the inset diameter to the venturi inlet diameter, D3:D1, may be greater than about 0.125 and less than about 0.55. The ratio of D3:D1 may be about 0.25. Other ratios of D3:D1 may be used.

The flow surface may have a planar, curvilinear, a combination thereof, or like configuration. Curvilinear includes concave, convex, and the like. The end outlet 644 and the flow surface may have a guide angle with the axis of the mixing chamber 630. The guide angle may be equal to or greater than about zero. The guide angle may be less than about 45 degrees. Other guide angles may be used.

The inset conduits 642 form one or more side outlets on the downstream sides 630. Each inset conduit 642 may have one or more side outlets. The side outlets are openings into the inset conduits 642 that direct the flow of exhaust gases into the mixing chamber 630. The side outlets may have different shapes.

The side outlets may be orifices 650, which may be circular, angular, rectangular, a combination thereof, or the like. The inset conduits 642 may have four or another number of orifices 650. The location of the inset conduits 642 and the location of the orifices 650 on the inset conduits 642 may position the orifices 650 substantially equidistant from each other. Other arrangements of the orifices 650 may be used. The orifices 650 may have an orifice diameter, D4. The ratio of the orifice diameter to the venturi inlet diameter, D4:D1, may be greater than about 0.025 and less than about 0.25. The ratio of D4:D1 may be about 0.12. Other ratios of D4:D1 may be used.

The EGR conduit 106 connects to the annular cavity 632 formed by the mixing conduit 620 and the venturi 622. The EGR conduit 106 may connect to the annular cavity 632 near the throat section 626. The EGR conduit 106 may be aligned with the inset conduits 642. The EGR conduit 106 has an EGR conduit diameter, D5. The ratio of the EGR conduit diameter to the venturi inlet diameter, D5:D1, may be greater than about 0.25 and less than about 0.75. The ratio of D5:D1 may be about 0.5. Other ratios of D5:D1 may be used.

In operation, exhaust gases mix with intake air in the mixing chamber 630 of the venturi 622. The exhaust gases flow from the EGR conduit 106 into the annular cavity 632 formed by the mixing conduit 620 and the venturi 622. The exhaust gases flow from the annular cavity 632 into the inset conduits 642. The annular cavity 632 may substantially equalize the pressure and flow of exhaust gases into the inset conduits 642. The exhaust gases flow from the inset conduits 642 through the end outlets 644 and the orifices 650 into the mixing chamber 630. The intake air flows from the intake air conduit 110 through the venturi inlet 634 into the mixing chamber 630. The intake air has a normal pressure in the intake air conduit 110.

In the mixing chamber 630, the venturi 622 generates a lower pressure region in the intake air. The intake air flows from the venturi inlet 634 through the inlet section 624 into the throat section 626. The inlet section 624 constricts the flow and thus increases the velocity of the intake air. As the velocity increases, the pressure of the intake air decreases. In the throat section 626, the intake air reaches a maximum velocity and a minimum pressure. In the outlet section 628, the velocity decreases and the pressure increases. The lower pressure region includes locations where the pressure of intake air is lower than the normal pressure. The lower pressure region may have a minimum pressure zone where the pressure of the intake air is essentially the minimum pressure.

The venturi 622 generates a turbulence field in the lower pressure region. As intake air flows through the throat section 626, the intake air engages and flows around the curved surfaces 652 of the inset conduits 642. On each inset conduit 642, the intake air forms a boundary layer along the curved surface 652. The pressure at the boundary layer decreases gradually as intake air moves along the curved surface 652 from the upstream side 648 toward the downstream side 646. The boundary layer stays attached to the inset conduit 642 while the pressure decreases. As intake air moves from the curved surface 652 to the flat surface 654, the boundary layer separates from the inset conduit 642. As the boundary layer separates, the intake air forms turbulent flow locations near the downstream side 646. The flow surface may generate turbulent flow locations in the intake air. In the turbulent flow locations, the intake air has irregular local velocities and pressures. The intake air may form one or more vortices in the turbulent flow locations. A vortex is a mass of swirling intake air that draws exhaust gases and/or other intake air toward the center of the vortex. Each inset conduit 642 may generate one or more turbulent flow locations near the downstream side 646. The turbulence field includes the turbulent flow locations.

The inset conduits 642 may direct intake air into the turbulence field. The flow surface on each inset conduit 642 may direct intake air passing the flow surface into the turbulent flow locations. The guide angle may be selected to direct intake air into the turbulent flow locations. The intake air flowing past the flow surfaces may have different flow directions than the intake air flowing around the inset conduits 642. The combination of intake air with different flow directions may increase the number, size, and/or intensity of the turbulent flow locations. The intake air flowing past the flow surfaces may have different pressures and velocities than intake air flowing around the inset conduits 642. The different pressures and velocities of the intake air may increase the number, size, and/or intensity of the turbulent flow locations.

The inset conduits 642 direct the exhaust gases into the turbulence field. The exhaust gases flow through the end outlets 644 and the orifices 650 into the turbulent flow locations near the downstream sides 646 of the inset conduits 642. The exhaust gases mix with the intake air in the turbulence field to form the combustion gas for the cylinders in the engine. The combustion gas flows from the mixing chamber 630 into the supply conduit 112.

Figure 9:
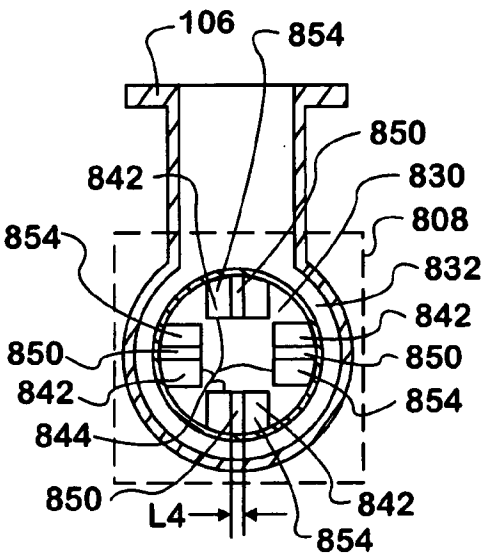
FIG. 9 is an end cross-section view of the venturi mixing device of FIG. 8.
Figure 8:
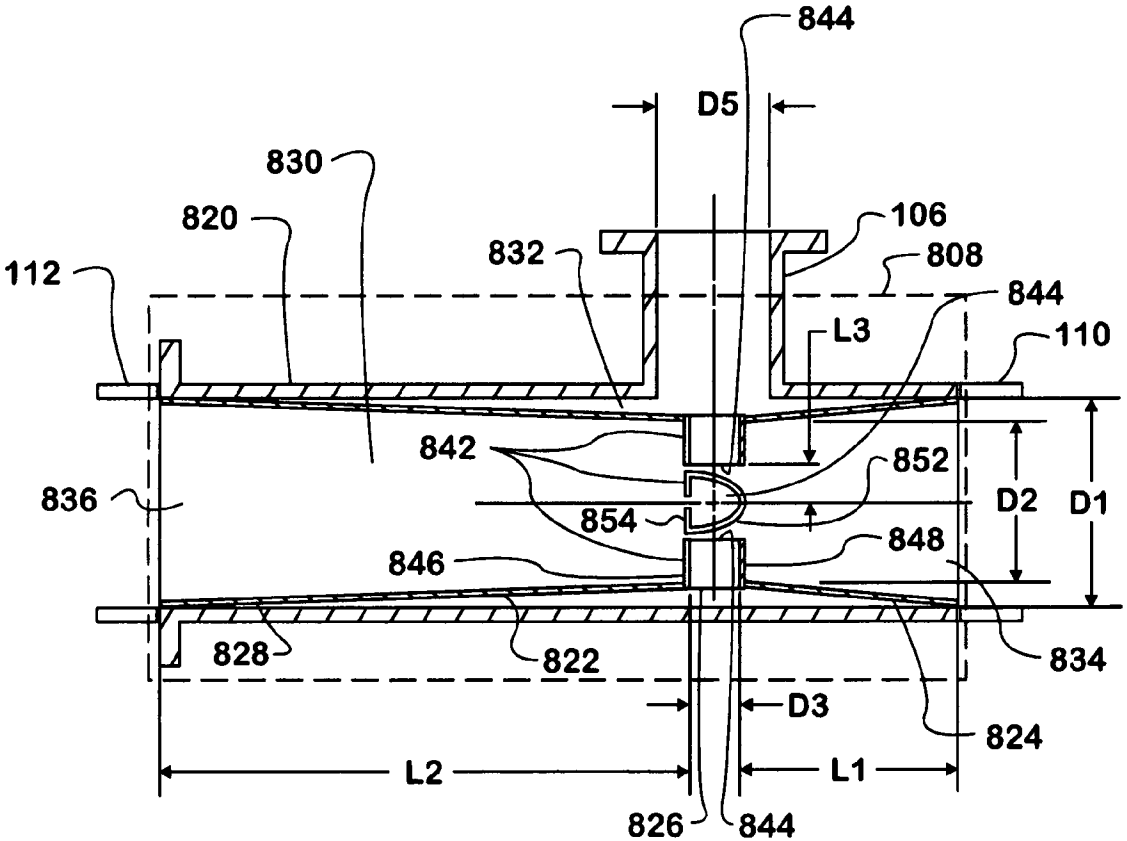
FIG. 8 is a side cross-section view of a further venturi mixing device for the venturi mixing system of FIG. 1.

FIGS. 8–9 are cross-section views of a further venturi mixing device 808 for a venturi mixing system. The venturi mixing device 808 is substantially the same as the venturi mixing device 208 except for the configuration of the inset conduits and the configuration of the side outlets. The venturi mixing device 808 has a mixing conduit 820 that connects to the EGR conduit 106, the intake air conduit 110, and the supply conduit 112. The mixing conduit 820 has essentially the same inside diameter as the intake air conduit 110 and the supply conduit 112. The mixing conduit 820 may be part or an extension of the intake air conduit 110, the supply conduit 112, or a combination thereof. The mixing conduit 820, the intake air conduit 110, and the supply conduit 112 may be the same component.

A venturi 822 is disposed inside the mixing conduit 820. The venturi 822 may be a machined component, a press metal sleeve, or the like. The venturi 822 has an inlet section 824 connected by a throat section 826 to an outlet section 828. The inlet section 824 connects with the mixing conduit 820 at or near the connection with the air intake conduit 110. The outlet section 828 connects with the mixing conduit 820 at or near the connection with the supply conduit 112. The venturi 822 and the mixing conduit 820 form an annular cavity 832. The venturi 822 forms a mixing chamber 830 having an axis or centerline.

The inlet section 824 forms a venturi inlet 834 at or near the connection with the air intake conduit 110. The inlet section 824 has an inlet length, L1, from the connection with the throat section 826 to the venturi inlet 834. The venturi inlet 834 has a venturi inlet diameter, D1. The inlet section 824 tapers down or reduces diameter from the venturi inlet 834 to the throat section 826. The throat section 826 has a throat diameter, D2. The ratio of the throat diameter to the venturi inlet diameter, D2:D1, may be greater than about 0.45 and less than about 0.95. The ratio of D2:D1 may be about 0.71. Other ratios of D2:D1 may be used. The ratio of the inlet length to the venturi inlet diameter, L1:D1, may be greater than about 0.5 and less than about 2.0. The ratio of L1:D1 may be about 1.0. Other ratios of L1:D1 may be used.

The outlet section 828 forms a venturi outlet 836 at or near the connection with the supply conduit 112. The venturi outlet 836 has essentially the same diameter as the venturi inlet 834. The outlet section 828 tapers up or increases diameter from the throat section 826 to the venturi outlet 836. The outlet section 828 has an outlet length, L2, from the connection with the throat section 826 to the venturi outlet 836. The ratio of the outlet length to the venturi inlet diameter, L2:D1, may be greater than about 1.5 and less than about 5.0. The ratio of L2:D1 may be about 2.5. Other ratios of L2:D1 may be used.

One or more inset conduits 842 are connected to the throat section 826. The inset conduits 842 extend radially into the mixing chamber 830. The inset conduits 842 may be perpendicular or at angle to the throat section 826. Multiple inset conduits 842 may be positioned equidistantly from each other along the circumference of the throat section. The throat section 826 may have four inset conduits 842 that are equidistant from each other and extend radially into the mixing chamber 830. Other numbers and positions of the inset conduits 842 may be used. The inset conduits 842 may have other orientations and arrangements.

The inset conduits 842 each have a downstream side 846 opposite an upstream side 848. The downstream side 846 faces the venturi outlet 836 and faces the connection of the supply conduit 112 with the mixing conduit 820. The upstream side 848 faces the venturi inlet 834 and faces the connection of the intake air conduit 110 with the mixing conduit 820.

Each inset conduit 842 may have an airfoil configuration with one end connected to the annular cavity 832. Each inset conduit 842 forms an end outlet 844 on the other end. The end outlet 844 produces a flow surface between exhaust gases in the inset conduit 842 and intake air in the mixing chamber 830. The airfoil configuration may have a curved surface 852 connected to a flat surface 854. The curved surface 852 includes parabolic, elliptical, a combination thereof, or like cross-sections. The flat surface 854 may be essentially flat, essentially planar, or the like. The upstream side 848 of the inset conduit 842 forms the curved surface 852. The downstream side 846 forms the flat surface 854. The airfoil configuration may reduce the air flow drag across the inset conduit 242. The inset conduit 842 may have other configurations.

Each inset conduit 842 positions the end outlet 844 and thus the flow surface at an offset distance, L3, from the axis of the mixing chamber 830. The offset distance, L3, is essentially the minimum distance of the end outlet 844 and the flow surface from the axis of the mixing chamber 830. Each inset conduit 842 has an inset diameter, D3. The ratio of the offset distance to the inset diameter, L3:D3, may be greater than about 1.0 and less than about 1.5. The ratio of L3:D3 may be about 1.1. Other ratios of L3:D3 may be used. The ratio of the inset diameter to the venturi inlet diameter, D3:D1, may be greater than about 0.125 and less than about 0.55. The ratio of D3:D1 may be about 0.25. Other ratios of D3:D1 may be used.

The flow surface may have a planar, curvilinear, a combination thereof, or like configuration. Curvilinear includes convex, concave, and the like. The end outlet 844 and the flow surface may have a guide angle with the axis of the mixing chamber 830. The guide angle may be equal to or greater than about zero. The guide angle may be less than about 45 degrees. Other guide angles may be used.

The inset conduits 842 form one or more side outlets on the downstream sides 830. Each inset conduit 842 may have one or more side outlets. The side outlets are openings into the inset conduits 842 that direct the flow of exhaust gases into the mixing chamber 830. The side outlets may have different shapes.

The side outlets may be slots 850, which may have a narrow rectangular or like configuration. A narrow rectangular configuration may have two longer sides in parallel adjacent to two shorter sides opposite each other. The shorter sides may have an essentially straight or circular shape. The shorter sides may be convex, concave, or a combination thereof. The inset conduits 842 may have four or another number of slots 850. The location of the inset conduits 842 and the location of the slots 850 on the inset conduits 842 may position the slots 850 substantially equidistant from each other. Other arrangements of the slots 850 may be used. The slots 850 may have a slot width, L4. The ratio of the slot width to the inset diameter, L4:D3, may be greater than about 0.2 and less than about 0.9. The ratio of L4:D3 may be about 0.25. Other ratios of L4:D3 may be used.

The EGR conduit 106 connects to the annular cavity 832 formed by the mixing conduit 820 and the venturi 822. The EGR conduit 106 may connect to the annular cavity 832 near the throat section 826. The EGR conduit 106 may be aligned with the inset conduits 842. The EGR conduit 106 has an EGR conduit diameter, D5. The ratio of the EGR conduit diameter to the venturi inlet diameter, D5:D1, may be greater than about 0.25 and less than about 0.75. The ratio of D5:D1 may be about 0.5. Other ratios of D5:D1 may be used.

In operation, exhaust gases mix with intake air in the mixing chamber 830 of the venturi 822. The exhaust gases flow from the EGR conduit 106 into the annular cavity 832 formed by the mixing conduit 820 and the venturi 822. The exhaust gases flow from the annular cavity 832 into the inset conduits 842. The annular cavity 832 may substantially equalize the pressure and flow of exhaust gases into the inset conduits 842. The exhaust gases flow from the inset conduits 842 through the end outlets 844 and the slots 850 into the mixing chamber 830. The intake air flows from the intake air conduit 110 through the venturi inlet 834 into the mixing chamber 830. The intake air has a normal pressure in the intake air conduit 110.

In the mixing chamber 830, the venturi 822 generates a lower pressure region in the intake air. The intake air flows from the venturi inlet 834 through the inlet section 824 into the throat section 826. The inlet section 824 constricts the flow and thus increases the velocity of the intake air. As the velocity increases, the pressure of the intake air decreases. In the throat section 826, the intake air reaches a maximum velocity and a minimum pressure. In the outlet section 828, the velocity decreases and the pressure increases. The lower pressure region includes locations where the pressure of intake air is lower than the normal pressure. The lower pressure region may have a minimum pressure zone where the pressure of the intake air is essentially the minimum pressure.

The venturi 822 generates a turbulence field in the lower pressure region. As intake air flows through the throat section 826, the intake air engages and flows around the curved surfaces 852 of the inset conduits 842. On each inset conduit 842, the intake air forms a boundary layer along the curved surface 852. The pressure at the boundary layer decreases gradually as intake air moves along the curved surface 852 from the upstream side 848 toward the downstream side 846. The boundary layer stays attached to the inset conduit 842 while the pressure decreases. As intake air moves from the curved surface 852 to the flat surface 854, the boundary layer separates from the inset conduit 842. As the boundary layer separates, the intake air forms turbulent flow locations near the downstream side 846. The flow surface may generate turbulent flow locations in the intake air. In the turbulent flow locations, the intake air has irregular local velocities and pressures. The intake air may form one or more vortices in the turbulent flow locations. A vortex is a mass of swirling intake air that draws exhaust gases and/or other intake air toward the center of the vortex. Each inset conduit 842 may generate one or more turbulent flow locations near the downstream side 846. The turbulence field includes the turbulent flow locations.

The inset conduits 842 may direct intake air into the turbulence field. The flow surface on each inset conduit 842 may direct intake air passing the flow surface into the turbulent flow locations. The guide angle may be selected to direct intake air into the turbulent flow locations. The intake air flowing past the flow surfaces may have different flow directions than the intake air flowing around the inset conduits 842. The combination of intake air with different flow directions may increase the number, size, and/or intensity of the turbulent flow locations. The intake air flowing past the flow surfaces may have different pressures and velocities than intake air flowing around the inset conduits 842. The different pressures and velocities of the intake air may increase the number, size, and/or intensity of the turbulent flow locations.

The inset conduits 842 direct the exhaust gases into the turbulence field. The exhaust gases flow through the end outlets 844 and the slots 850 into the turbulent flow locations near the downstream sides 846 of the inset conduits 842. The exhaust gases mix with the intake air in the turbulence field to form the combustion gas for the cylinders in the engine. The combustion gas flows from the mixing chamber 830 into the supply conduit 112.

Figure 10:
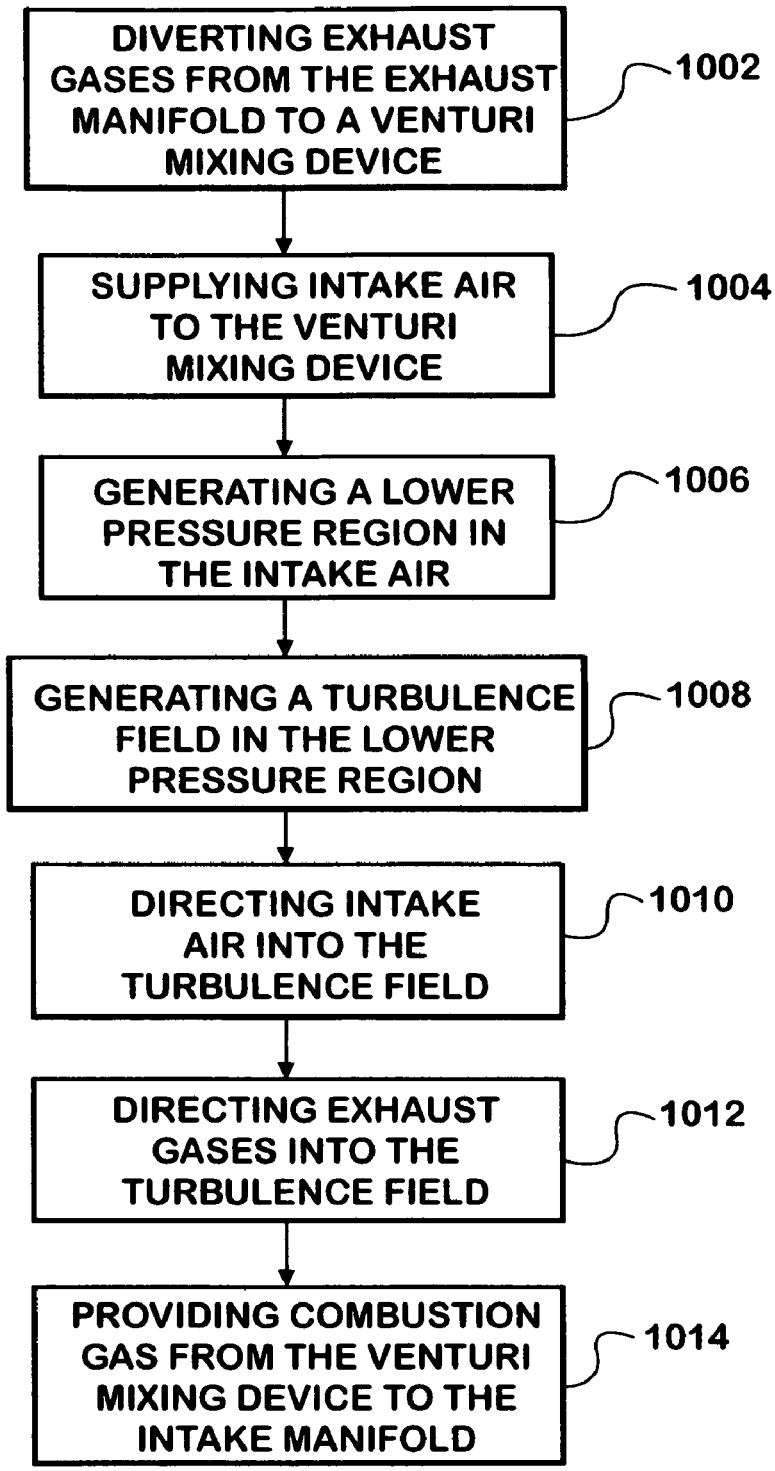
FIG. 10 is a flowchart of a method for mixing exhaust gases with intake air in an internal combustion engine.

FIG. 10 is a flowchart of a method for mixing exhaust gases with intake air in an internal combustion engine. The exhaust gases and intake air are directed into a turbulence field generated in a lower pressure region of the intake air as previously discussed.

In block 1002, the exhaust gases are diverted from the exhaust manifold to a venturi mixing device. The exhaust gases exit the cylinders in the internal combustion engine and accumulate in the exhaust manifold. The exhaust gases flow from the exhaust manifold through an exhaust conduit to exit the engine. The exhaust conduit may be connected to a turbine inlet for the exhaust gases to pass through the turbine portion of a turbocharger prior to exiting. An EGR conduit connects the exhaust conduit to the venturi mixing device. The EGR conduit diverts a portion of the exhaust gases from the exhaust conduit to the venturi mixing device. The amount of exhaust gases diverted to the venturi mixing device may be controlled to provide a selected concentration of exhaust gases in the intake air. The selected concentration may vary during engine operation. Other exhaust gas recirculation systems including those with additional components may be used to divert a portion of the exhaust gases to the venturi mixing device.

In block 1004, intake air is supplied to the venturi mixing device. An intake air conduit is connected to the venturi mixing device. Intake air flows through the intake air conduit to the venturi mixing device. The intake air conduit may be connected to the compressor side of a turbocharger.

In block 1006, the venturi mixing device generates a lower pressure region in the intake air. The intake air flows from the intake air conduit into a venturi in the venturi mixing device. The intake air flows through a venturi inlet into the inlet section of the venturi. From the inlet section, the intake air flow through a throat section into an outlet section. The inlet section constricts the flow and thus increases the velocity of the intake air. As the velocity increases, the pressure of the intake air decreases. In the throat section, the intake air may reach a maximum velocity and a minimum pressure. In the outlet section, the velocity decreases and the pressure increases. The lower pressure region includes locations where the pressure of intake air is lower than the normal pressure. The venturi may generate a minimum pressure zone in the lower pressure region. The minimum pressure zone includes locations in the lower pressure region where the pressure of the intake air is essentially the minimum pressure.

In block 1008, the venturi mixing device generates a turbulence field in the lower pressure region. As intake air flows through the throat section of the venturi, the intake air engages and flows around inset conduits. The intake air forms a boundary layer on each inset conduit. The pressure at the boundary layer decreases gradually as intake air moves along from the upstream side toward the downstream side of the inset conduit. The boundary layer stays attached to the inset conduit while the pressure decreases. As intake air moves from the upstream side to the downstream side, the pressure at the boundary layer increases. The increased pressure separates the boundary layers from the inset conduit. As the boundary layer separates, the intake air forms turbulent flow locations near the downstream side of the inset conduit. The intake air may form one or more vortices in the turbulent flow locations. The inset conduit may produce a flow surface that generates turbulent flow locations in the intake air. Each inset conduit may generate one or more turbulent flow locations near the downstream side. The turbulence field includes the turbulent flow locations.

In block 1010, the inset conduits direct intake air into the turbulence field. Each inset conduit has a flow surface that may direct intake air into the turbulent flow locations. The flow surface may have a guide angle with the axis of the mixing chamber formed by the venturi. The guide angle may be selected to direct intake air into the turbulent flow locations. The intake air flowing past the flow surface may have a different flow direction than the intake air flowing around the inset conduit. The combination of intake air with different flow directions may increase the turbulent flow locations. The intake air flowing past the flow surface may have different pressures and velocities than intake air flowing around the inset conduits. The different pressures and velocities of the intake air may increase the turbulent flow locations.

In block 1012, the inset conduits direct the exhaust gases into the turbulence field. The exhaust gases flow through the end and side outlets into the turbulent flow locations near the downstream sides of the inset conduits. The exhaust gases mix with the intake air in the turbulence field to form the combustion gas for the cylinders in the engine.

In block 1014, the combustion gas is provided to the intake manifold of the engine. A supply conduit connects the venturi mixing device to the intake manifold. The combustion gas flows from the venturi mixing device to the intake manifold.

While various embodiments of the invention have been described, it will be apparent to those of ordinary skill in the art that other embodiments and implementations are possible within the scope of the invention. Accordingly, the invention is not to be restricted except in light of the attached claims and their equivalents.

What is claimed is:

1. A venturi mixing system for exhaust gas recirculation (EGR) in an internal combustion engine, comprising:

a venturi mixing device;

an intake air conduit connected to the venturi mixing device;

a supply conduit connected to the venturi mixing device;

at least two inset conduits connected to the venturi mixing device;

an EGR conduit connected to an annular cavity of the venturi mixing device;

where the venturi mixing device generates a lower pressure region in intake air from the intake air conduit;

where the at least two inset conduits are in fluid communication with the annular cavity;

where the at least two inset conduits generate a turbulence field in the lower pressure region;

where the venturi mixing device directs exhaust gases from the EGR conduit into the turbulence field; and where the venturi mixing device provides a combustion gas to the supply conduit.

2. The venturi mixing system of claim 1, where the venturi mixing device directs intake air into the turbulence field.

3. The venturi mixing system of claim 1, where the venturi mixing device generates a minimum pressure zone in the lower pressure region; and where the venturi mixing device directs the exhaust gases from the EGR conduit into the minimum pressure zone.

4. The venturi mixing system of claim 1, where the combustion gas has a selected concentration of exhaust gases in the intake air.

5. The venturi mixing system of claim 1, further comprising:

a mixing conduit connected to the intake air conduit and to the supply conduit;

a venturi disposed in the mixing conduit, where venturi and the mixing conduit form an annular cavity, where the EGR conduit is connected to the annular cavity; where the venturi forms a mixing chamber; and where the at least one inset conduit extends into the mixing chamber, where the at least one inset conduit forms an end outlet, where the at least one inset conduit forms at least one side outlet on a downstream side, and where the end outlet and the at least one side outlet direct the exhaust gases into the at least one turbulent flow location.

6. The venturi mixing system of claim 5, where the at least one inset conduit produces a flow surface, and where the flow surface directs intake air into the turbulence field.

7. The venturi mixing system of claim 5, where the at least one side outlet is an orifice.

8. The venturi mixing system of claim 5, where the at least one side outlet is a slot.

9. The venturi mixing system of claim 5, where the at least one inset conduit has a cylindrical configuration.

10. The venturi mixing system of claim 5, where the at least one inset conduit has an airfoil configuration.

11. A venturi mixing system for exhaust gas recirculation (EGR) in an internal combustion engine, comprising:

a mixing conduit;

a venturi disposed in the mixing conduit, where the venturi and the mixing conduit form an annular cavity, where the venturi forms a mixing chamber;

an intake air conduit connected to the venturi;

a supply conduit connected to the venturi;

an EGR conduit connected to the annular cavity; and at least two inset conduits in fluid communication with the annular cavity, where the at least two inset conduits generate at least one turbulent flow location in intake air from the intake air conduit, where the at least two inset conduits extend into the mixing chamber, where the at least two inset conduits each form an end outlet, where each of the at least two inset conduits form at least one side outlet on a downstream side.

12. The venturi mixing system of claim 11, where the venturi has an inlet section connected by a throat section to an outlet section;

where the inlet section forms a venturi inlet, where the inlet section has an inlet length from the throat section to the venturi inlet, where the venturi inlet has a venturi inlet diameter;

where the throat section has a throat diameter; and where the outlet section forms a venturi outlet, where the outlet section has an outlet length from the throat section to the venturi outlet.

13. The venturi mixing system of claim 12, where the ratio of the throat diameter to the venturi inlet diameter is greater than about 0.45; and where the ratio of the throat diameter to the venturi inlet diameter is less than about 0.95.

14. The venturi mixing system of claim 13, where the ratio of the throat diameter to the venturi inlet diameter is about 0.71.

15. The venturi mixing system of claim 12, where the ratio of the inlet length to the venturi inlet diameter is greater than about 0.5; and where the ratio of the inlet length to the venturi inlet diameter is less than about 2.0.

16. The venturi mixing system of claim 15, where the ratio of the inlet length to the venturi inlet diameter is about 1.0.

17. The venturi mixing system of claim 12, where the ratio of the outlet length to the venturi inlet diameter is greater than about 1.5; and where the ratio of the outlet length to the venturi inlet diameter is less than about 5.0.

18. The venturi mixing system of claim 17, where the ratio of the outlet length to the venturi inlet diameter is about 2.5.

19. The venturi mixing system of claim 12, where the at least one inset conduit has an inset diameter;

where the ratio of the inset diameter to the venturi inlet diameter is greater than about 0.125; and where the ratio of the inset diameter to the venturi inlet diameter is less than about 0.55.

20. The venturi mixing system of claim 19, where the ratio of the inset diameter to the venturi inlet diameter is about 0.25.

21. The venturi mixing system of claim 12, where the end outlet produces a flow surface at an offset distance from an axis of the mixing chamber, and where the flow surface forms a guide angle with the axis.

22. The venturi mixing system of claim 21, where the ratio of the offset distance to the inset diameter is greater than about 1.0; and where the ratio of the offset distance to the inset diameter is less than about 1.5.

23. The venturi mixing system of claim 22, where the ratio of the offset distance to the inset diameter is about 1.1.

24. The venturi mixing system of claim 21, where the guide angle is equal to about zero.

25. The venturi mixing system of claim 21, where the guide angle is greater than about zero, and where the guide angle is less than about 45 degrees.

26. The venturi mixing system of claim 12, where each of the at least one side outlets is an orifice.

27. The venturi mixing system of claim 26, where the orifice has an orifice diameter;

where the ratio of the orifice diameter to the venturi inlet diameter is greater than about 0.025; and where the ratio of the orifice diameter to the venturi inlet diameter is less than about 0.25.

28. The venturi mixing device of claim 27, where the ratio of the orifice diameter to the venturi inlet diameter is about 0.12.

29. The venturi mixing system of claim 12, where each of the at least one side outlets is a slot.

30. The venturi mixing system of claim 29, where the slot has a slot width;

where the at least one inset conduit has an inset diameter;

where the ratio of the slot width to the inset diameter is greater than about 0.2; and where the ratio of the slot width to the inset diameter is less than about 0.9.

31. The venturi mixing system of claim 16, where the ratio of the slot width to the inset diameter is about 0.25.

32. The venturi mixing system of claim 12, where the EGR conduit has an EGR conduit diameter;

where the ratio of the EGR conduit diameter to the venturi inlet diameter is greater than about 0.25; and where the ratio of the EGR conduit diameter to the venturi inlet diameter is less than about 0.75.

33. The venturi mixing system of claim 32, where the ratio of the EGR conduit diameter to the venturi inlet diameter is about 0.5.

34. The venturi mixing system of claim 11, where each of the at least two inset conduits has a cylindrical configuration.

35. The venturi mixing system of claim 11, where each of the at least two inset conduits has an airfoil configuration.

36. The venturi mixing system of claim 11, further comprising:

an exhaust conduit connected to the EGR conduit;

an exhaust manifold connected to the exhaust conduit; and an intake manifold connected to the supply conduit.

37. A venturi mixing device for exhaust gas recirculation (EGR) in an internal combustion engine, comprising:

a mixing conduit;

a venturi disposed in the mixing conduit, where the venturi and the mixing conduit form an annular cavity, where the venturi forms a mixing chamber, where the venturi has an inlet section connected by a throat section to an outlet section, where the inlet section forms a venturi inlet, where the inlet section has an inlet length from the throat section to the venturi inlet, where the venturi inlet has a venturi inlet diameter, where the throat section has a throat diameter, and where the outlet section forms a venturi outlet, where the outlet section has an outlet length from the throat section to the venturi outlet; and at least two inset conduits in fluid communication with the annular cavity, where the at least two inset conduits generate at least one turbulent flow location in intake air from the venturi inlet, where the at least two inset conduits extend into the mixing chamber, where the at least two inset conduits have an inset diameter, where each of the at least two inset conduits form an end outlet at an offset distance from an axis of the mixing chamber, where each of the end outlets has a guide angle with the axis, and where each of the at least two inset conduits form at least one side outlet on a downstream side.

38. The venturi mixing device of claim 37, where the ratio of the throat diameter to the venturi inlet diameter is greater than about 0.45 and less than about 0.95;

where the ratio of the inlet length to the venturi inlet diameter is greater than about 0.5 and less than about 2.0;

where the ratio of the outlet length to the venturi inlet diameter is greater than about 1.5 and less than about 5.0;

where the ratio of the inset diameter to the venturi inlet diameter is greater than about 0.125 and less than about 0.55; and where the ratio of the offset distance to the inset diameter is greater than about 1.0 and less than about 1.5.

39. The venturi mixing device of claim 38, where the guide angle is equal to about zero.

40. The venturi mixing device of claim 38, where the guide angle is greater than about zero, and where the guide angle is less than about 45 degrees.

41. The venturi mixing device of claim 38, where the at least one side outlet is an orifice;

where the orifice has an orifice diameter; and where the ratio of the orifice diameter to the venturi inlet diameter is greater than about 0.025 and less than about 0.25.

42. The venturi mixing device of claim 38, where the at least one side outlet is a slot;

where the slot has a slot width;

where the at least one inset conduit has an inset diameter; and where the ratio of the slot width to the inset diameter is greater than about 0.2 and less than about 0.9.

43. The venturi mixing device of claim 37, where the ratio of the throat diameter to the venturi inlet diameter is about 0.71;

where the ratio of the inlet length to the venturi inlet diameter is about 1.0;

where the ratio of the outlet length to the venturi inlet diameter is about 2.5;

where the ratio of the inset diameter to the venturi inlet diameter is about 0.25; and where the ratio of the offset distance to the inset diameter is about 1.1.

44. The venturi mixing device of claim 43, where the guide angle is equal to about zero.

45. The venturi mixing device of claim 43, where the guide angle is greater than about zero; and where the guide angle is less than about 45 degrees.

46. The venturi mixing device of claim 43, where the at least one side outlet is an orifice;

where the orifice has an orifice diameter; and where the ratio of the orifice diameter to the venturi inlet diameter is about 0.12.

47. The venturi mixing device of claim 43, where the at least one side outlet is a slot;

where the slot has a slot width;

where the at least one inset conduit has an inset diameter; and where the ratio of the slot width to the inset diameter is about 0.25.

48. The venturi mixing device of claim 37, where each of the at least two inset conduits has a cylindrical configuration.

49. The venturi mixing device of claim 37, where each of the at least two inset conduits has an airfoil configuration.

50. A method for mixing exhaust gases with intake air in an internal combustion engine, comprising:

generating a lower pressure region in intake air;

generating a turbulence field in the lower pressure region with at least two inset conduits; and directing exhaust gases from an annular cavity into the turbulence field through the at least two inset conduits, wherein the at least two fluid conduits are fluidly communicating with the annular cavity.

51. The method for mixing exhaust gases with intake air of claim 50, further comprising directing intake air into the turbulence field.

52. The method for mixing exhaust gases with intake air of claim 50, further comprising:

generating a minimum pressure zone in the lower pressure region; and directing the exhaust gases into the minimum pressure zone.

53. The method for mixing exhaust gases with intake air of claim 50, further comprising:

diverting exhaust gases from an exhaust manifold; and providing combustion gas to an intake manifold.

* * * * *